US007992804B2

(12) United States Patent
Nauels

(10) Patent No.: US 7,992,804 B2
(45) Date of Patent: Aug. 9, 2011

(54) DISPENSER

(75) Inventor: Bernd Nauels, Krefeld (DE)

(73) Assignee: Stockhausen GmbH, Krefeld (DE)

( * ) Notice: Subject to any disclaimer, the term of this patent is extended or adjusted under 35 U.S.C. 154(b) by 951 days.

(21) Appl. No.: 11/661,228

(22) PCT Filed: Feb. 14, 2006

(86) PCT No.: PCT/EP2006/050934

§ 371 (c)(1),
(2), (4) Date: Oct. 31, 2007

(87) PCT Pub. No.: WO2006/084920

PCT Pub. Date: Aug. 17, 2006

(65) Prior Publication Data

US 2011/0147416 A1 Jun. 23, 2011

(30) Foreign Application Priority Data

Feb. 14, 2005 (DE) ..... 10 2005 006 845

(51) Int. Cl.
*B05B 7/30* (2006.01)

(52) U.S. Cl. ..... 239/349

(58) Field of Classification Search ..... 222/181.1, 222/181.2, 181.3, 341, 511–518, 402.15, 222/340; 239/302, 333, 337, 349, 355, 359, 239/360

See application file for complete search history.

(56) References Cited

U.S. PATENT DOCUMENTS

| | | | | | |
|---|---|---|---|---|---|
| 4,360,130 | A | * | 11/1982 | Nishimura et al. | 222/153.09 |
| 4,621,749 | A | * | 11/1986 | Kanfer | 222/153.01 |
| 5,165,577 | A | * | 11/1992 | Ophardt | 222/181.2 |
| 5,282,552 | A | | 2/1994 | Ophardt | |
| 5,373,970 | A | * | 12/1994 | Ophardt | 222/181.2 |
| 5,638,989 | A | * | 6/1997 | Ophardt et al. | 222/105 |
| 2004/0232168 | A1 | | 11/2004 | Ciavarella | |

FOREIGN PATENT DOCUMENTS

| | | |
|---|---|---|
| DE | 2727679 | 11/1978 |
| EP | 0703831 | 3/1995 |
| EP | 0650687 | 6/1999 |
| WO | WO9407113 | 3/1994 |
| WO | WO9826702 | 6/1998 |

* cited by examiner

*Primary Examiner* — Davis Hwu

(74) *Attorney, Agent, or Firm* — Stetina Brunda Garred & Brucker

(57) ABSTRACT

The invention relates to a dispenser for a substance, comprising a housing (1), a reservoir (2), a metering valve (3), and an actuator (4). In known dispensers, the metering valve (3) is positively coupled to the actuator (4) via coupling means when the metering valve is activated for the first time. The invention is characterized in that the coupling means can be activated by inserting a the reservoir (2) into the housing (1) and by the respective relative movement between the housing (1) and the reservoir (2) in the direction of insertion (E) thereby eliminating an idle movement after the insertion of the reservoir.

11 Claims, 7 Drawing Sheets

DISPENSER

TECHNICAL BACKGROUND

The invention relates to a dispenser, in particular as a metering dispenser for the administration of a semisolid or liquid substance, such as, for example, liquid soap or a cleansing or skin care foam. The generic dispenser encompasses a housing, the housing rear wall of which can be mounted on a wall and which is covered by a cover being pivotably connected with the housing rear wall. The reservoir, which contains the substance and which encompasses a metering valve for the controlled dispensing of the substance, is located behind the cover.

To fill the reservoir, it is replaced, mostly together with the metering valve. For this, the housing encompasses a container receptacle for accommodating the reservoir. The reservoir can be inserted into the container receptacle in a direction of insertion. By means of a stroke movement of a valve element, a predetermined quantity of the substance can then be dispensed, with the valve element being opened or closed via an actuator disposed on the housing, which is able to transmit an actuating force to the valve element via at least one pressure element.

In particular, the dispenser encompasses coupling means disposed on the housing, which produce a positive connection between the valve element and the actuator either directly or indirectly at least in the direction of movement of the valve element. These coupling means are formed by at least one retaining edge and by at least one carrier, which at least partially encompasses the retaining edge with a carrier receptacle and which are configured in such a manner that the retaining edge engages with the carrier receptacle in response to an insertion of the reservoir in the direction of insertion.

Dispensers of this type are known from DE 27 27 679 B2. In these dispensers, however, the housing must be tilted forward and the reservoir must then be inserted into the opened cover so that said cover can then be tilted back together with the reservoir. In addition to the fact that the comparatively high load strains the mechanics of the cover, these dispensers have the further disadvantage that the reservoir can only be used if the cover is held with one hand and if the reservoir is inserted with the other hand. Furthermore, the cover must always be tightly closed with the housing so as to prevent an automatic opening.

Other dispensers are known from EP 0 650 687 B1 or EP 0703 831 B1, into which a reservoir is inserted into the housing, for example for refilling the substance. For this, the housing encompasses a clamping connection, which accommodates the reservoir with a removal opening pointing downwards. A retaining support projecting at right angles from a base plate of the housing disposed on a wall is used as a clamping connection. Said retaining support is disposed between the metering valve and the reservoir. The actuator is disposed below the metering valve as a pivotable "push" button and is connected with the housing.

As is the case with the known dispensers, the coupling means formed by elastic snap-in pins push against an edge of the metering valve projecting laterally outwardly when the actuator is actuated for the first time. Through this, the outer edge of the metering valve, which serves as a flange, engages with the elastic snap-in device of the coupling means and the actuator is coupled with the metering valve until the reservoir is removed from the housing.

For example, the actuator is provided with a "push" button extending at right angles towards the rear so that a pushing of the "push" button causes an upward movement of the region projecting at right angles towards the rear. Through this, a piston of the metering valve is moved upwards, with a substance being dispensed at the same time. In response to the subsequent return of the "push" button into the initial position, the piston is lowered again and an output reservoir disposed in the pistons is filled with substance again. The return of the "push" button into the initial position is effected via a return spring, for example.

Even though the known dispensers are capable of reliably dispensing a substance, they have the disadvantage that the elastic pins of the coupling means must grab the flange of the outwardly projecting metering valve in response to the actuation for the first time. During this first initial movement, the metering valve is inoperable and mechanical snap-in noises occur instead.

Furthermore, there is a danger that the snap-in elements are slightly bent in response to an inappropriate insertion of the reservoir so that either the snap-in position is canceled or the snap-in pins are disposed perpendicular to the upper side of the flange so that, due to the upward movement of the metering valve, the displacement of the snap-in pins can no longer be realized. In this case, the dispenser would be inoperable due to the jamming of the snap-in pins.

DISCLOSURE OF THE INVENTION

Technical Problem

It is thus the object of the invention to create a dispenser, into which the reservoir can easily be inserted with an operation using one hand and which enables a reliable operation without the impression of an initial error function.

Technical Solution

This object is solved according to the invention in that the container receptacle is disposed on the housing rear wall and that it can be inserted into the container receptacle after the pivoting of the cover of the reservoirs, wherein the coupling means encompass a threading aid, which is formed by a supply, which narrows in the direction of insertion guiding the retaining edge into the carrier receptacle during the insertion movement of the reservoir.

The coupling means are activated by the insertion of the reservoir into the housing and the relative movement between the housing and the reservoir in the direction of insertion connected therewith, that is to say the positive connection between the carrier and the retaining edge is already realized by the insertion. For filing purposes, the dispenser can now simply be opened and the reservoir can be inserted. For this, the housing encompasses a corresponding fastener, in particular a support plate extending from the rear wall forward, into which the reservoir is inserted.

The threading aid ensures that during the insertion movement the retaining edge of the metering valve is caught and is threaded into the carrier. For this, the threading aid is configured as a component forming a gap, which narrows in the direction of the carrier or as having such a gap itself, wherein the retaining edge is guided in the gap during the insertion movement.

The embodiment of the dispenser as claimed in the invention does not only ensure that the reservoir can be easily inserted using one hand but that the occurrence of the impression of error functions can also be prevented because the valve is already in the operating position in response to the first actuation and because an engagement movement must not first be added. For this, the coupling means are engaged directly after the insertion of the reservoir.

With several embodiments of the metering device it is only required that a one-time actuation of the actuator activates the metering valve, that is to say that the substance is drawn from the newly inserted full reservoir into the valve body. Provided that such an initial filling is not necessary, if, for example, the chamber of the metering valve has already been filled by the manufacturer, the dispenser is then ready for use immediately after the filling. Compared with the known dispensers, an idle movement for activating the valve is thus eliminated.

In a preferred embodiment of the invention, the retaining edge is formed by an edge laterally projecting outwardly from the metering valve. This may be a peripherally running flange, for example. Said flange is disposed in a region of the valve, which must be moved up and down in response to a conventional mode of operation of the valve. With a piston-actuated valve, this can be a region of the metering valve, which is connected with the piston.

If a bubble-shaped pressure reservoir is used as a valve, the retaining edge can also be disposed peripherally around the wall of said pressure reservoir. The carrier receptacle is disposed in the housing in such a manner that it can be moved together with the actuator. Preferably, a known "push" button is used here as well, which encompasses a perpendicularly disposed handle and an area of operation projecting at right angles therefrom in the direction of the housing rear wall.

The carrier receptacle can then be disposed at the upper region of the operational receptacle. It is important for the function of the carrier receptacle that it is capable of transmitting forces to the retaining edge, both in the upwards and downwards movements of the actuator. Generally, the carrier receptacle is thus configured as a slot, into which the retaining edge engages in response to an insertion of the reservoir in the direction of insertion.

Preferably, the functional components are configured in cylindrical manner in the dispenser as claimed in the invention, because they are made in a blow molding operation, for example. Preferably, the functional elements of the metering device are embodied as cylindrical components as well, because they are plastic components as well, which can be produced very cost-efficiently without production problems.

Consequently, the retaining edge will then also be configured as a peripheral ring flange. In this embodiment, it lends itself that the carrier receptacle surrounds the entire retaining edge, with the exception of the front region. This leads to an annular carrier receptacle, which, at the same time, can also assume the function of the clamping effect and of the retaining effect for the reservoir. By simply inserting the reservoir into the carrier receptacle, the reservoir can thus be fastened and can ensure the function of the metering device, provided that a pressure element is available for transmitting a retaining force in vertical direction.

So as to be able to easily and simply insert the reservoir without laborious threading during a rapid refilling operation, it is preferred to use an accommodation fork, which is moved by the actuator and which facilitates the threading of the retaining edge. In an embodiment, this can mean that the upper part of the carrier receptacle is formed by the accommodation fork. The lower part is then formed by the base plate of the actuating button disposed at right angles to the housing rear wall.

The retaining edge is thus disposed between the base plate and the accommodation fork. In the upper direction, it is thus supported on the lower side of the accommodation fork and in the lower direction it is supported on the upper side of the base plate. So as to be able to use the metering valve with this embodiment, the base plate preferably encompasses an aperture, through which the metering valve can be inserted, wherein the entire reservoir can subsequently be pushed backwards in the direction of the housing rear wall. To make this possible, the aperture for the metering valve is preferably configured in a slot-like or oblong hole-like manner.

For facilitating the threading process, the accommodation fork preferably encompasses brackets, which widen towards the front, between which the retaining edge can be adjusted. The brackets can be angled towards the top so that it is possible to lead the retaining edge into the later end position in a pinpointed manner.

Preferably, the brackets of the accommodation fork are either configured in an elastic manner or an elastic tensioning fork is provided at the base plate of the actuator in addition to the accommodation fork. This elastic accommodation fork or the elastic tensioning fork can ensure the necessary mechanical stability and, at the same time, offer a snap-in function, which reliably holds the reservoir in the position of use.

Generally, due to the fact that the actuating button can generally be pivoted about a horizontal axis and the base plate thus does not only move upward but upward on a circular path, a smaller force component arises, which acts on the reservoir from below facing away from the housing rear wall. This additional force component can easily be accommodated by a metallic or stable plastic fork. Therefore, it may be reasonable to provide a metallic tensioning fork in addition to the embodiment of the actuating butting and the accommodation fork.

The accommodation fork can be integrally connected with the base plate of the "push" button. In this case, both parts are preferably made as injection molding parts. In the alternative, a metallic accommodation fork, for example, can also be connected with the base plate via a plug-in connection or a riveted connection.

Alternatively to the above-described embodiment, it goes without saying that the retaining edge can also project inwardly and that the metering valve can encompass a peripheral groove. The retaining edge can thus, for example, be formed by the accommodation fork, which is inserted into the groove with only a slight play. In this embodiment, the actuator is connected with the metering valve exclusively via the accommodation fork or the accommodation fork in connection with the tensioning fork, for example.

The metering valve itself can be configured in a particularly simple manner as a balloon valve, which encompasses a draw-in reservoir, which is compressed by the movement of the actuator in a first direction in the direction of the housing rear wall. With this, the substance is pushed out of the balloon valve. A substance is then again drawn in from the reservoir by means of the subsequent backwards movement in the second direction away from the housing rear wall. At the same time, small amounts of residue of the substance at the output nozzle are again drawn back into the balloon. Membranes at both sides of the balloon lead to a tightness so that a dripping of the metering valve is avoided.

In this embodiment, the draw-in reservoir and the reservoir can easily be made of a single plastic component, which can be produced in a blow molding operation, for example. For this, the diameter of a hose below the reservoir is reduced by means of a corresponding molding to such an extent that a shorter or longer inlet channel arises between the two volumes, the draw-in reservoir on the one side and the reservoir on the other side.

The draw-in reservoir itself can have different shapes. Depending on the use of material, bellow-like compression regions can be provided or the draw-in reservoir is configured as a spherical volume, which can simply be compressed by means of the actuator with lateral migration of the conversion region.

Additional features and advantages of the invention result from the subclaims and from the following description of preferred exemplary embodiments by means of the drawings.

THE BEST MODE FOR USING THE INVENTION

Figure 1:
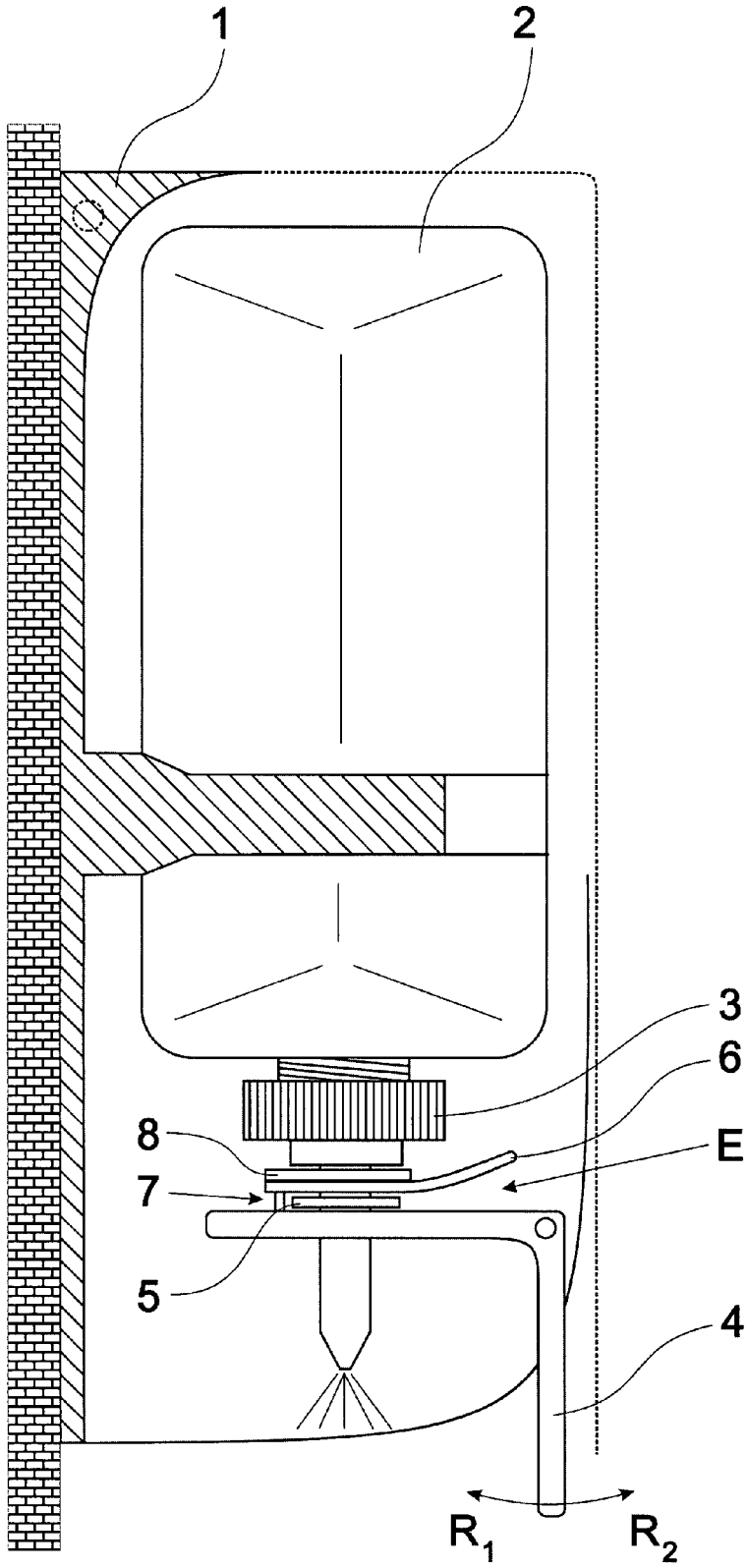
FIG. 1 a dispenser as claimed in the invention in a side view in section.

FIG. 1 illustrates a dispenser encompassing a housing 1, into which a reservoir 2 can be inserted in the direction of insertion E. The reservoir can include a semisolid or a liquid substance, in particular cleansers or skin care products. The substance can be removed via a metering valve 3, which can be actuated either manually or electrically.

An actuator 4, which is illustrated herein as a manual device, is provided for actuating the metering valve 2. A manual actuating force applied by the operator is hereby transmitted to the valve element via a pressure element. The metering valve 2 can thereby be embodied in such a manner that it is able to dispense a predefined quantity of a liquid agent. It can also be configured as a foam valve so that the substance is foamed in response to the actuation. For the actuation of the metering valve 3, the actuator 4 must be able to move an element of the metering valve 3 back and forth relative to the reservoir 2. This requires that a part of the metering valve 3 is guided in the actuator 4 in perpendicular direction.

The illustrated embodiment encompasses coupling means, which are activated in response to an insertion of the reservoir into the housing 1.

While with the known dispenser an activation takes place only if retaining tongues slip beyond an edge of the coupling means and engage in an elastic manner in response to the actuation of the actuator 4 for the first time, according to the invention an activation of the coupling means is directly effected by the insertion. For this, provision is made for a retaining edge 5, which interacts with a carrier receptacle of a carrier 6. In response to the insertion of the reservoir 2 into the housing 1, this requires for the retaining edge 5 to slide underneath the carrier 6 and thus, together with the upper side of the actuator 4, encloses the retaining edge 5, which laterally projects from the metering valve 3.

If the actuator 4 is now placed in motion into the first direction of actuation $R_1$ by applying a manual pressure force, a pressure force is exerted on the valve region located below the metering valve 3 in the illustrated exemplary embodiment. Due to the fact that the retaining edge 5 is positively held in vertical direction, this has the effect that the lower region of the metering valve, which is movable in the metering valve 3, is pushed upwards and is pulled downwards again into the second direction of actuation $R_2$ in response to a subsequent spring-back of the push button. Due to this stroke movement, the substance is initially drawn out of the reservoir 2 into a clearance of the metering valve 3.

At the same time, in response to the same movement, the portion of the substance, which had already been drawn in in response to a preceding actuation, is output downwards or into any other desired direction.

Figure 2:
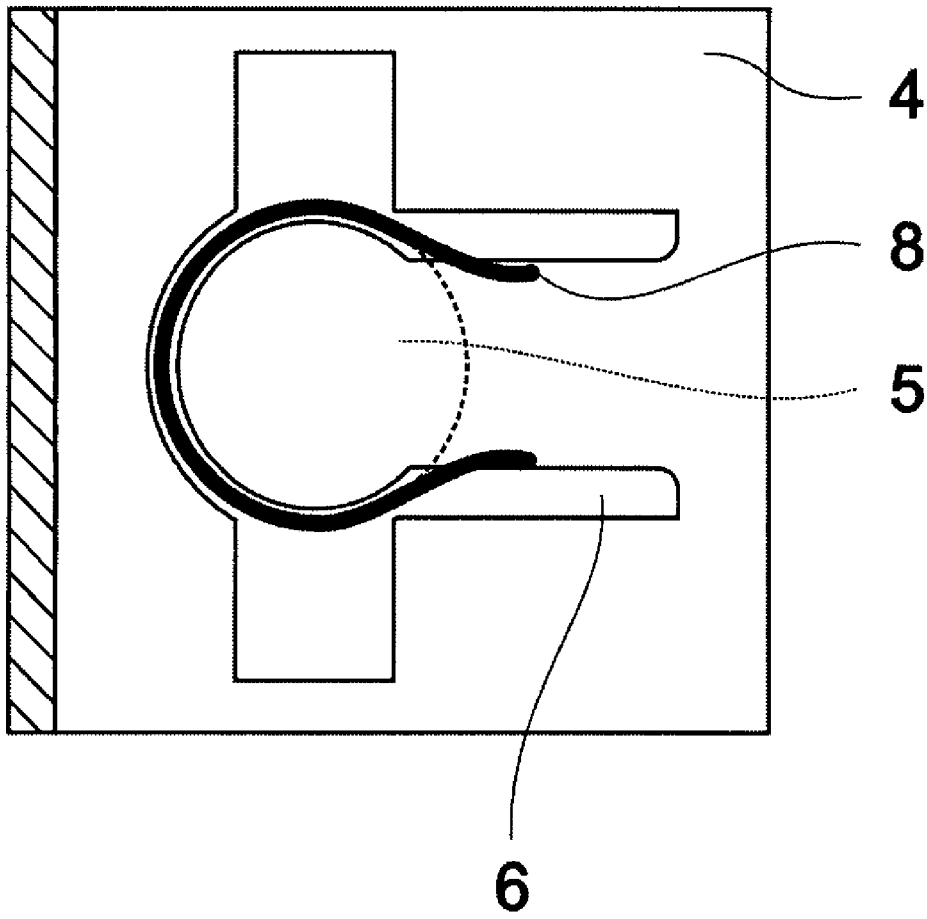
FIG. 2 a top view onto the coupling means of the dispenser illustrated in FIG. 1, FIG. 3 a first alternative embodiment of the metering pump in a diagrammatic view, FIG. 4 a second embodiment of the metering pump in a diagrammatic view, FIG. 5 a third embodiment of the metering pump in a diagrammatic view, FIG. 6 a fourth embodiment of the metering pump in a diagrammatic view and FIG. 7 a fifth embodiment of the metering pump in a diagrammatic view.
Figure 3:
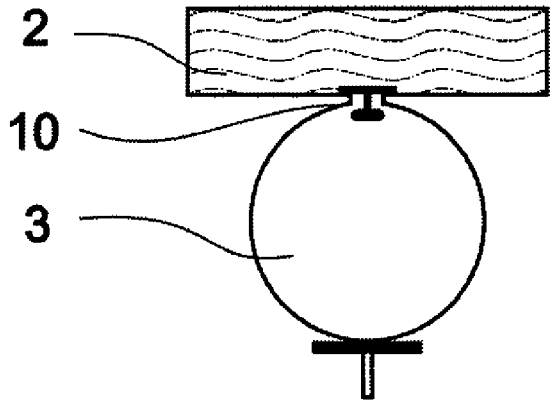
Figure 4:
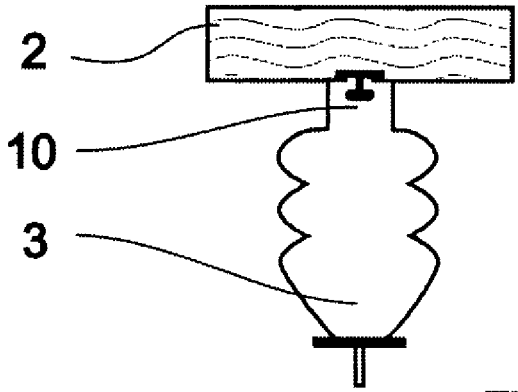
Figure 5:
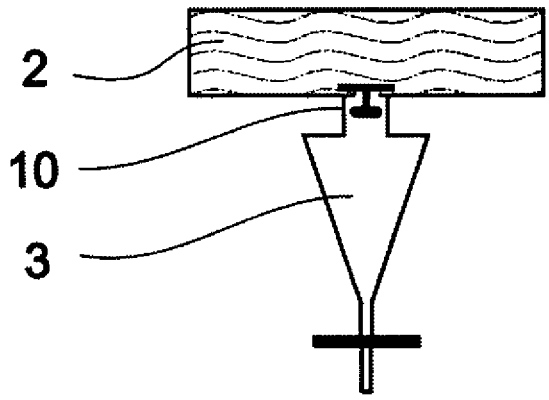
Figure 6:
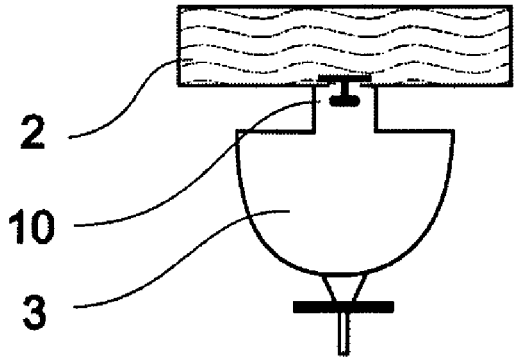
Figure 7:
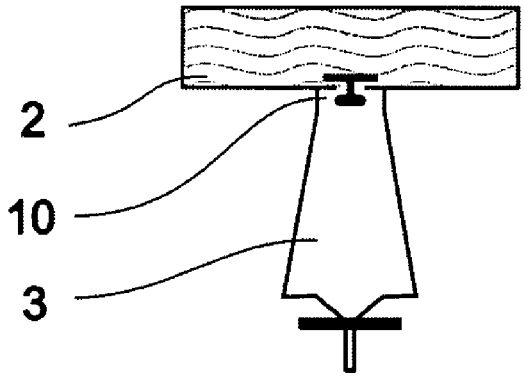

FIG. 2 shows the region of the accommodation fork 6 and of the tensioning fork 8 from the top. The carrier 7 (not visible herein) is formed by the upper side of the push button, which is used as actuator 4, and by the lower side of the accommodation fork 6, with the retaining edge 5 here being a flange laterally projecting from the non-illustrated metering valve 3.

FIGS. 3 to 7 illustrate five alternative embodiments of the metering valve 3, all of which are substantially based on a balloon technique, wherein a round, half-round, bellow-like balloon or a balloon continuously widening and narrowing in vertical direction is used. Said balloon is sealed in the upper and lower region via membrane valves.

The membrane valves, and, it goes without saying that, in the alternative, other embodiments can also be used, effect a closing in the upper transitional region to the reservoir 2 and an opening in the lower region, in response to a pushing of the push button, so as to be able to push downward the content of the balloon out of said balloon. In response to a spring-back of the push button, the lower valve is then closed so that the negative pressure can build up for drawing in the substance.

The described embodiments of the metering valve 3 are to be treated as exemplary embodiments only. Other valves can also be used in context with the invention.

LIST OF REFERENCE NUMERALS

1 housing
2 reservoir
3 metering valve
4 actuator
5 retaining edge
6 accommodation fork
7 carrier
8 tensioning fork
9 suction reservoir
10 infeed channel
direction of insertion
$R_1$ first direction (of actuation)
$R_2$ second direction (of actuation)

The invention claimed is:

1. A dispenser, in particular a metering dispenser for the administration of a semisolid or liquid substance, comprising a housing (1) encompassing a cover being mountable on a wall with a housing rear wall and a cover being pivotably connected herewith, a reservoir (2) being insertable into a container receptacle in a direction of insertion (E) in housing (1), a metering valve (3) disposed on the reservoir (2) being able to dispense a predetermined quantity of the substance by means of a stroke movement of a valve element and an actuator (4) disposed on the housing being capable of transmitting an actuating force to the valve element via at least one pressure element for actuating the metering valve (3), wherein the dispenser encompasses coupling means disposed particularly on the housing (1), said coupling means being capable of producing a positive connection between the valve element and the actuator (4) either directly or directly at least in the direction of movement of the valve element and being formed by at least one retaining edge (5) and at least one carrier (6) at least partially encompassing the retaining edge (5) with a carrier receptacle and wherein the coupling means are configured in such a manner that the retaining edge (5) engages with the carrier receptacle in response to an insertion of the reservoir (2) in the direction of insertion (E), characterized in that the container receptacle is disposed on the housing rear wall and that it can be inserted into the container receptacle after pivoting the cover of the reservoirs (2), wherein the coupling means encompass a threading aid being formed by a supply narrowing in the direction of insertion, which guides the retaining edge (5) into the carrier receptacle during the insertion movement of the reservoir (2).

2. The dispenser according to claim 1, characterized in that the retaining edge (5) is formed by an edge laterally projecting from the metering valve.

3. The dispenser according to claim 2, characterized in that the threading aid is formed by an accommodation fork (7), which opens in a direction opposite the direction of insertion (E), wherein at least a part of the carrier receptacle is formed by the rear edges of the accommodation fork (7), viewed in the direction of insertion (E).

4. The dispenser according to claim 3, characterized in that the housing rear wall encompasses side walls projecting forward and in that the actuator (4) is an actuating button mounted on at least one of the side walls in a pivotable manner, which encompasses the carrier receptacle in a rear region extending in the direction of the housing rear wall and facing the reservoir (2).

5. The dispenser according to claim 4, characterized in that a side of the accommodation fork (7) and the side facing the housing rear wall form the carrier receptacle.

6. The dispenser according to the claim 5, characterized in that, in addition to the accommodation fork (7) provision is made for an elastic tensioning fork (8), which is disposed concentrically to the accommodation fork (7) at the upper and lower side thereof, into which the retaining edge (5) disposed at least bilaterally to the metering valve (3) can be engaged in a spring-elastic manner.

7. The dispenser according to claim 6, characterized in that the housing rear wall encompasses a support plate with an aperture supporting the reservoir (2) and projecting forward, wherein the metering valve (3) with an output channel for the substance for dispensing the substance downward is guided through the aperture.

8. The dispenser according to claim 1, characterized in that the coupling means are formed by a groove being disposed in the metering valve (3) and parallel to the direction of insertion (E) and by at least one retaining edge (5) projecting from the actuator (4) in the direction of the groove.

9. The dispenser according to claim 1, characterized in that the metering valve (3) is formed by a suction reservoir (9) connected with the reservoir (2) being capable of being compressed by the movement of the actuator (4) into a first direction ($R_1$) for outputting a predefined substance quantity and being capable of drawing in substance from the reservoir (2) for drawing in a further portion of the substance into a second direction ($R_2$) in response to a movement.

10. The dispenser according to claim 9, characterized in that the suction reservoir (9) and the reservoir (2) are made of a single plastic component and in that an infeed channel (10), which can be closed via a valve in response to a movement of the actuator (4) in the first direction, is disposed between the suction reservoir (9) and the reservoir (2).

11. The dispenser according to the claim 10, characterized in that the suction reservoir (9) and the reservoir (2) are made of a plastic hose in a blow molding operation.

* * * * *